US008967684B2

(12) United States Patent
Phelps

(10) Patent No.: US 8,967,684 B2
(45) Date of Patent: Mar. 3, 2015

(54) SELF-ALIGNING WINDOW SASH LOCK

(75) Inventor: Walter E. Phelps, Williamsville, VT (US)

(73) Assignee: Phelps Company Architectural Specialties, Inc., Brattleboro, VT (US)

( * ) Notice: Subject to any disclaimer, the term of this patent is extended or adjusted under 35 U.S.C. 154(b) by 583 days.

(21) Appl. No.: 13/039,106

(22) Filed: Mar. 2, 2011

(65) Prior Publication Data

US 2011/0219697 A1 Sep. 15, 2011

Related U.S. Application Data

(60) Provisional application No. 61/313,905, filed on Mar. 15, 2010.

(51) Int. Cl.

| | |
|---|---|
| ***E05C 3/02*** | (2006.01) |
| ***E05B 15/00*** | (2006.01) |
| *E05C 3/04* | (2006.01) |
| *E05C 3/14* | (2006.01) |
| *E05C 7/00* | (2006.01) |

(52) U.S. Cl.

CPC ..... *E05B 15/0006* (2013.01); *E05C 3/043* (2013.01); *E05C 2007/007* (2013.01); *Y10S 292/20* (2013.01); *Y10S 292/47* (2013.01)

USPC .... 292/240; 292/241; 292/242; 292/DIG. 20; 292/DIG. 47

(58) Field of Classification Search

USPC ..... 292/240, 241, 242, DIG. 20, DIG. 47

See application file for complete search history.

(56) References Cited

U.S. PATENT DOCUMENTS

| | | | | | |
|---|---|---|---|---|---|
| 744,755 | A * | 11/1903 | Hasenpflug | 292/242 |
| 756,559 | A * | 4/1904 | Arens | 292/242 |
| 900,079 | A * | 10/1908 | Bittorf | 292/242 |
| 2,422,723 | A * | 6/1947 | Fisher | 292/204 |
| 2,679,416 | A * | 5/1954 | Tassell | 292/242 |
| 2,846,258 | A * | 8/1958 | Granberg | 292/336 |
| 4,063,766 | A * | 12/1977 | Granberg | 292/336 |
| 5,161,839 | A * | 11/1992 | Piltingsrud et al. | 292/241 |
| 6,523,868 | B1 * | 2/2003 | Timothy | 292/241 |
| 6,565,133 | B1 * | 5/2003 | Timothy | 292/242 |
| 6,568,723 | B2 * | 5/2003 | Murphy et al. | 292/241 |
| 7,017,957 | B2 * | 3/2006 | Murphy et al. | 292/241 |
| 8,434,797 | B2 * | 5/2013 | Langer | 292/241 |

* cited by examiner

*Primary Examiner* — Kristina Fulton
*Assistant Examiner* — Faria Ahmad
(74) *Attorney, Agent, or Firm* — Downs Rachlin Martin PLLC

(57) ABSTRACT

A sash lock for single- and double-hung window installations having upper and lower sashes having respective lower and upper check rails. The sash lock includes a latch for being pivotably mounted to the upper check rail of the lower sash, and a catch for being fixedly secured to the lower check rail of the upper sash. The latch includes a draw member, and the catch has a concave surface for being slidably engaged by the draw member. The concave surface is configured so that when the draw member is increasingly engaged with the catch the sash lock forces the upper and lower sashes into proper vertical alignment with one another regardless of whether upper check rail of the lower sash is initially above or below the lower check rail of the upper sash.

18 Claims, 5 Drawing Sheets

SELF-ALIGNING WINDOW SASH LOCK

RELATED APPLICATION DATA

This application claims the benefit of priority of U.S. Provisional Patent Application No. 61/313,905, filed Mar. 15, 2010, entitled "Self-Aligning Window Sash Lock," which is incorporated herein by reference in its entirety.

FIELD OF THE INVENTION

The present invention generally relates to the field of double-hung window hardware. In particular, the present invention is directed to a self-aligning window sash lock.

BACKGROUND

Historically, sash locks for double hung windows have served several purposes. The first sash locks served only to prevent the windows from being opened, the traditional function of a lock. The sash lock later evolved to serve two other purposes, to draw the check rails of the upper and lower sashes together tightly, and to a limited extent, force the upper sash in an upwards direction and the lower sash in a downwards direction. Both of these functions serve to make the window more weather-tight.

SUMMARY OF THE DISCLOSURE

In one implementation, the present disclosure is directed to a sash lock for a window installation having an upper sash and a lower sash, wherein 1) the upper sash includes a window pane and a lower check rail having a first upper side, 2) the lower sash includes an upper check rail having a second upper side, and 3) at least one of the upper and lower sashes is slidable relative to the other of the upper and lower sashes in a vertical plane parallel to the window pane. The sash lock includes: a latch configured to be secured to the upper check rail of the lower sash on the second upper side in a manner that the latch is pivotable horizontally, the latch including a draw member having a catch-contacting surface that is arcuate in a horizontal plane; and a catch configured to be fixedly secured to the lower check rail of the upper sash on the first upper side, the latch including a draw-member-contacting surface for slidingly receiving the catch-contacting surface of the latch, wherein, when the sash lock is installed in the window installation, the draw-member-contacting surface: is concave in a vertical plane perpendicular to the window pane and in a direction perpendicularly away from the window pane; has an upper portion for contacting the catch-contacting surface of the draw member so as to generate a first point-contact force having: a vertical component for drawing the upper and lower check rails together; and a horizontal component for vertically aligning the upper and lower check rails with one another; and has a lower portion for contacting the catch-contacting surface of the draw member so as to generate a second point-contact force having: a vertical component for drawing the upper and lower check rails together; and a horizontal component for vertically aligning the upper and lower check rails with one another.

In another implementation, the present disclosure is directed to a window installation. The window installation includes: an upper sash that includes a window pane and a lower check rail having a first upper side; a lower sash that includes an upper check rail having a second upper side, wherein: at least one of the upper and lower sashes is slidable relative to the other of the upper and lower sashes in a vertical plane parallel to the window pane; and the upper and lower sashes have a desired vertical alignment relationship when properly locked together; and a sash lock that includes: a latch secured to the upper check rail of the lower sash on the second upper side in a manner that the latch is pivotable horizontally, the latch including a draw member having a catch-contacting surface that is arcuate in a horizontal plane; and a catch fixedly secured to the lower check rail of the upper sash on the first upper side, the latch including a draw-member-contacting surface for slidingly receiving the catch-contacting surface of the latch, wherein the draw-member-contacting surface: is concave in a vertical plane perpendicular to the window pane and in a direction perpendicularly away from the window pane; has an upper portion for contacting the catch-contacting surface of the draw member so as to generate a first point-contact force having: a vertical component for drawing the upper and lower check rails together; and a horizontal component for vertically aligning the upper and lower check rails with one another; has a lower portion for contacting the catch-contacting surface of the draw member so as to generate a second point-contact force having: a vertical component for drawing the upper and lower check rails together; and a horizontal component for vertically aligning the upper and lower check rails with one another; and has a nadir between the upper and lower portions, wherein, when the upper and lower sashes are properly locked together by the sash lock and are in the desired vertical alignment, the draw member is located substantially at the nadir.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

Figure 1A:
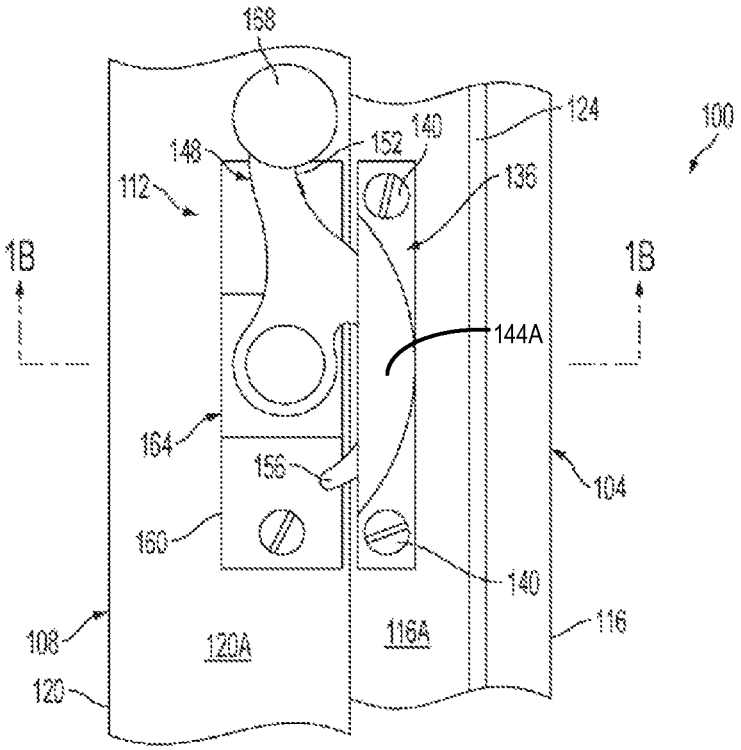
FIG. 1A is a horizontal cross-sectional view of a window installation that includes a sash lock made in accordance with the present invention, showing the sash lock in a fully locked configuration.
Figure 1B:
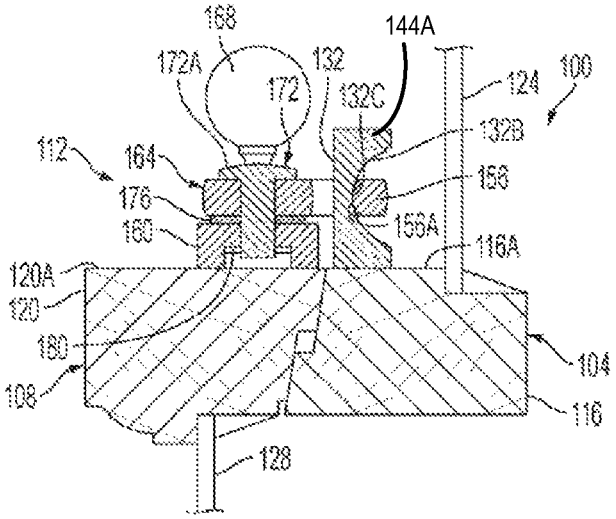
FIG. 1B is a cross-sectional view as taken along line 1B-1B of FIG. 1A.

Referring now to the drawings, FIGS. 1A-B illustrate a window installation 100 that includes an upper sash 104 and a lower sash 108, one, the other, or both of which are vertically movable in the manner of conventional single- and double-hung windows. Window installation 100 also includes a sash lock 112 that has features that not only effectively draws upper and lower sashes 104, 108 together at their meeting parts, but also acts to precisely vertically align the upper and lower sashes, regardless of the direction of the initial vertical misalignment. These and other features of sash lock 112 are described below in detail. However, before presenting those details, a few contextual details of components of window installation 100 other than sash lock 112 are first described. It is noted that as used herein and in the appended claims, the terms "upper," "lower," "vertical," "horizontal" and like terms, express conventional positional relationships and orientations relative to an installed sash-over-sash window system.

Upper sash 104 includes a lower check rail 116 having an upper surface 116A, and lower sash 108 includes an upper check rail 120 having an upper surface 120A. As in conventional single- and double-hung window installations, when upper and lower sashes 104, 108 are in their proper closed positions lower check rail 116 and upper check rail 120 meet with one another such that their respective upper surfaces 116A, 120A are flush with one another. Also as in conventional single- and double-hung window installations, window installation 100 includes other parts, such as window panes 124, 128, side and head jambs (not shown) and sill, among other things. As those skilled in the art will readily appreciate, lower and upper check rails 116, 120 can be made from any one or more materials. For example, each rail 116, 120 may be made from wood, plastic or metal covered wood, a metal extrusion, a plastic extrusion or plastic covered metal, among others. Those skilled in the art will also readily appreciate that window panes 124, 128 can be made of any suitable sheet material, such as glass (coated and uncoated) or plastic and may have any number of layers that can include one or more reflective layers, one or more filtering layers, etc. Upper and lower sashes 104, 108 can be of any age. That is, sash lock 112 can be used in virtually any new or retrofit installation, although various parts of the sash lock may need to be modified dimensionally or otherwise to accommodate special circumstances that may arise in some installations.

Figure 2A:
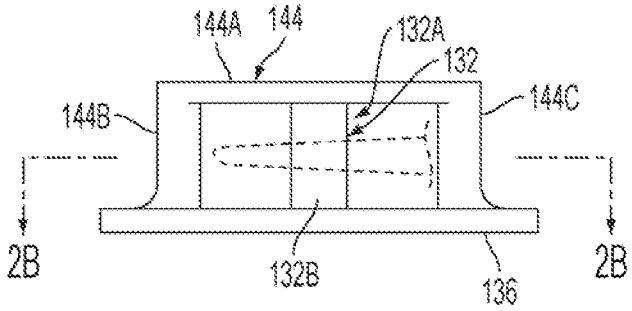
FIG. 2A is an elevational view of the catch of the sash lock of FIGS. 1A-B.
Figure 2B:
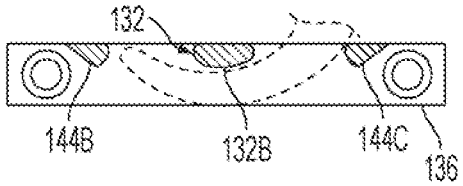
FIG. 2B is a cross-sectional view as taken along line 2B-2B of FIG. 2A.

Sash lock 112 includes a catch 132 fixedly secured to lower check rail 116 of upper sash 104. In this example, catch 132 is fixedly attached to a base 136 that allows the catch to be readily secured to the lower check rail using suitable fasteners, such as screws 140 shown. As best seen in FIG. 2A-B, in this embodiment a catch-upper-end support 144 is included to provide additional support to upper end 132A of catch 132. Support 144 includes a horizontal member 144A and two posts 144B-C joining the horizontal member to base 136. In the embodiment shown, catch 132, base 136 and catch-upper-end support 144 are monolithic and formed in a single casting. In other embodiments, one or more of these components can be formed separately from the other(s) and then attached to one another using any suitable attachment means/method(s). In one example, catch 132, base 136 and catch-upper-end support 144 are made of brass, but these parts can, of course, be made of other suitable materials. It is noted that while this embodiment includes a base 136, other embodiments can include some other means for securing catch 132 to lower check rail 116.

Referring particularly to FIGS. 1B and 2A-B, it is seen that catch 132 has an arcuate contact surface 132B, as viewed in a vertical plane such as the plane of the section of FIG. 1B, that is concave in a direction away from window pane 124. As described in more detail below, this shape and concavity give sash lock 112 its ability to vertically align upper and lower sashes 104, 108 with one another upon actuating the sash lock to lock the sashes together. The curvature of contact surface 132B can be circular, spiral, elliptical, etc. If circular, the radius of curvature can be any suitable to achieve the vertical alignment functionality. For example, in some embodiments the radius of curvature can be about 2 inches (about 5 cm) or less, and more preferably, about 1 inch (about 2.5 cm) or less. FIG. 2B shows that contact surface 132B can also be contoured in a generally horizontal direction to enhance operability of sash lock 112.

Referring again to FIGS. 1A-B, in addition to catch 132 on lower check rail 116 of upper sash 104, sash lock 112 also includes a latch 148 pivotably secured to upper check rail 120 of lower sash 108. Latch 148 includes a handle lever 152 and a draw member 156 that has a contact surface 156A that contacts contact surface 132B of catch 132 during use of sash lock 112 and generally defines a spiral shape configured to draw the catch and lower check rail 116 toward upper check rail 120 as a user pivots, in this example, latch 148 in a clockwise direction so as to fully engage draw member 156 with the catch. When fully engaged, sash lock 112 firmly holds lower and upper check rails 116, 120 into engagement with one another, including any weather stripping/sealing that may be located therebetween. As seen in FIG. 1B, draw member 156 engages contact surface 132B of catch 132 at the nadir 132C of the concavity of that surface when lower and upper check rails 116, 120 are properly vertically aligned with one another. This fact, in combination with the concavity of contact surface 132B of catch 132 and the configuration of draw member 156, act together to provide sash lock 112 with the ability to vertically align lower and upper check rails 116, 120 with one another so that they end up in their proper vertical alignment when the sash lock is fully engaged. This is described below in further detail.

In the embodiment shown in FIGS. 1A-B, latch 148 is pivotably connected to a base 160 to form a latch assembly 164. Base 160 allows latch assembly 164 to be fixedly attached to upper check rail 120, in this example using a pair of screws. While this arrangement is shown, those skilled in the art will readily appreciate that in other embodiments, pivotable latch 148 could be attached to a different style of base or other structure for securing the latch to a corresponding upper check rail. For example, such an alternative base may be integrally formed with the check rail. In addition, in some embodiments base 160 may be eliminated altogether. Those skilled in the art will readily understand the many variations that are possible within the scope of the present invention. The illustrated embodiment of latch 148 includes a grip 168 that a user can grasp with his/her fingers to pivot the latch during use.

In this embodiment, latch 148 is pivotably attached to base 160 using a pin arrangement in which a pin 172 is secured to the base and the latch is effectively clamped between a head 172A on the pin and a low-friction bearing 176 that is sandwiched between the latch and the base. A retainer 180 secures pin 172 to base 160. As those skilled in the art will readily understand, there are other ways of pivotably attaching latch 148 to base 160 or other structure. In the example shown, latch 148, grip 168, base 160 and pin 172 are separate components and are all made of brass, retainer 180 is made of steel and friction bearing 176 is made of nylon. In other embodiments these parts can be made of any one or more suitable materials, which may be selected not only for their mechanical suitability, but also for their aesthetic qualities.

Figure 3A:
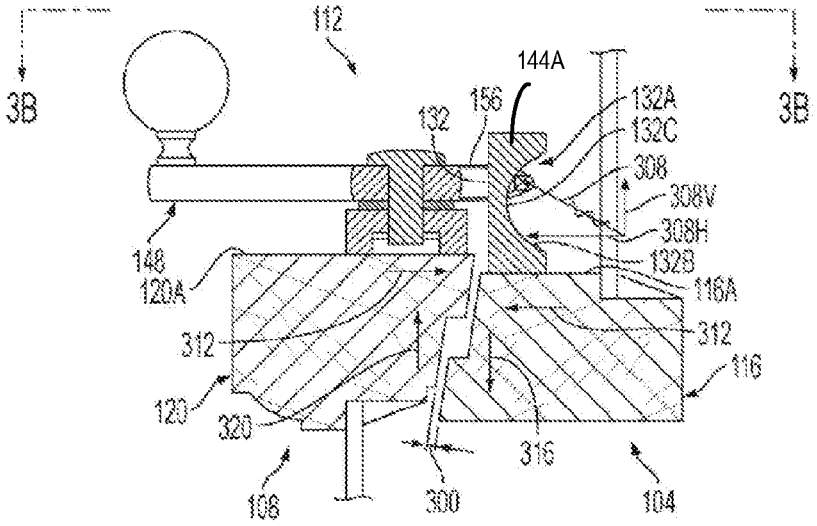
FIG. 3A is a vertical cross-sectional view of the window installation of FIGS. 1A-B showing the upper and lower sashes vertically misaligned such that the upper surface of the lower check rail of the upper sash is higher than the upper surface of the upper check rail of the lower sash.
Figure 3B:
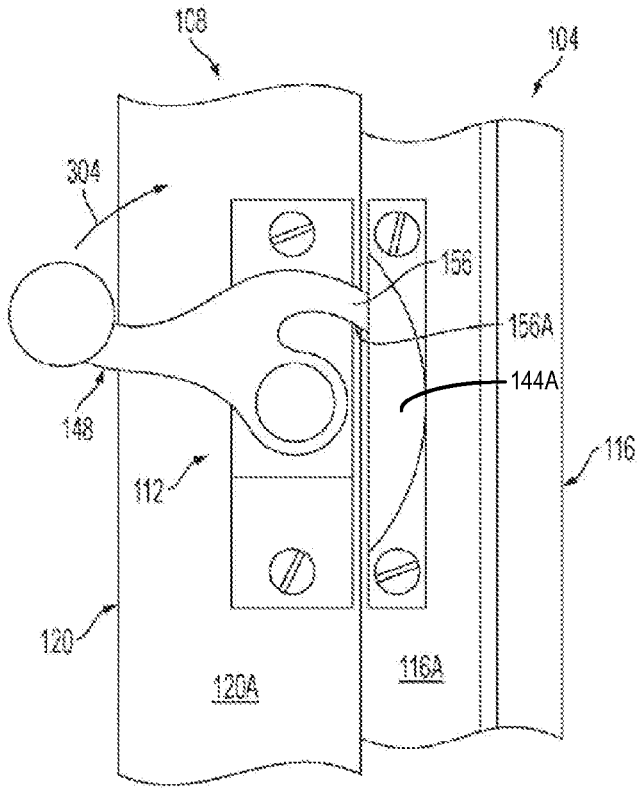
FIG. 3B is a cross-sectional view as taken along line 3B-3B of FIG. 3A.

Having described the structure of sash lock 112, its operation is now described. Referring first to FIGS. 3A-B, these figures illustrate a scenario in which sash lock 112 is being used when upper surface 120A of upper check rail 120 of lower sash 108 is initially higher than upper surface 116A of lower check rail 116 of upper sash 104 and there is a loose fit between the check rails, as illustrated by gap 300. In this case, when a user (not shown) pivots latch 148 counterclockwise, as illustrated by arrow 304 (FIG. 3B), draw member 156 initially contacts contact surface 132B of catch 132 near upper end 132A of the catch. Then, as the user continues to pivot latch 148 clockwise, spiral contact surface 156A on draw member 156 acts on catch 132 to impart a contact force 308 (FIG. 3A) that is normal to contact surface 132B on the catch. Because contact surface 132B is sloped as shown, contact force 308 has not only a horizontal component 308H, which acts to draw lower and upper check rails 116, 120 together (as indicated by arrows 312 (FIG. 3A)), but also a vertical component 308V, which acts to cause upper sash 104 to move upward (as indicated by arrow 316 (FIG. 3A)) and/or cause lower sash 108 to move downward (as indicated by arrow 320). As those skilled in the art should be able to readily envision, as the user continues to pivot latch 148 clockwise, the movement of upper and lower sashes 104, 108 continues until draw member 156 is at nadir 132C of contact surface 132B of catch 132. At that point, which is best shown in FIG. 1B, upper surfaces 116A, 120A of lower and upper check rails 116, 120, respectively, are flush with one another. In addition, if latch 148 is pivoted to its fully engaged position, as illustrated in FIG. 1A, gap 300 (FIG. 3A) will be at a minimum.

Figure 4A:
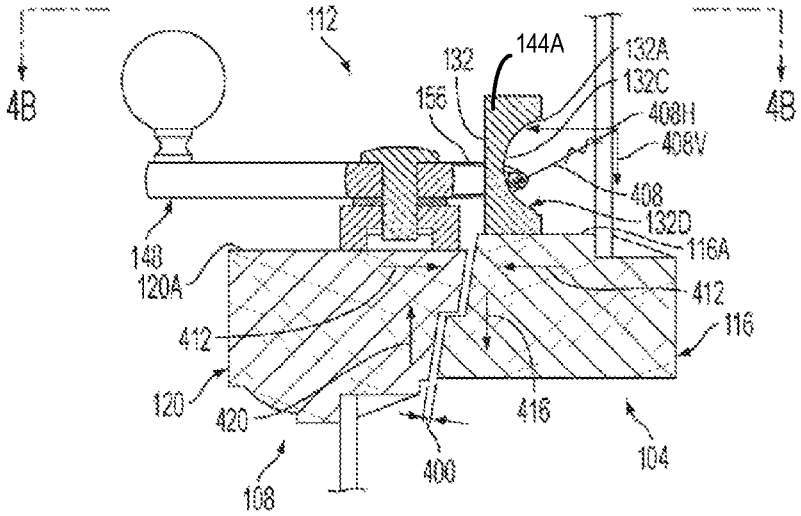
FIG. 4A is a vertical cross-sectional view of the window installation of FIGS. 1A-B showing the upper and lower sashes vertically misaligned such that the upper surface of the lower check rail of the upper sash is lower than the upper surface of the upper check rail of the lower sash.
Figure 4B:
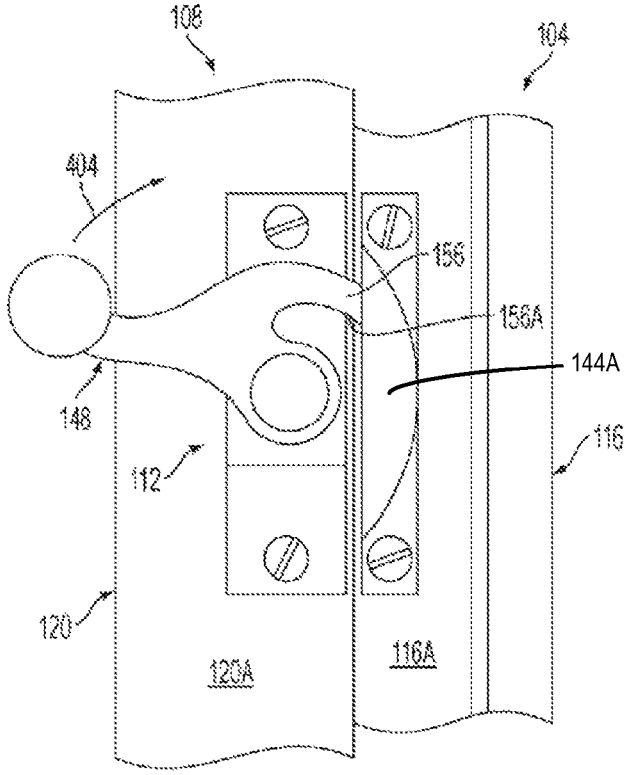
FIG. 4B is a cross-sectional view as taken along line 4B-4B of FIG. 4A.

Referring now to FIGS. 4A-B, these figures illustrate a scenario in which sash lock 112 is being used when upper surface 120A of upper check rail 120 of lower sash 108 is initially lower than upper surface 116A of lower check rail 116 of upper sash 104 and there is a loose fit between the check rails, as illustrated by gap 400. In this case, when a user (not shown) pivots latch 148 counterclockwise, as illustrated by arrow 404 (FIG. 4B), draw member 156 initially contacts contact surface 132B of catch 132 near lower end 132D of the catch. Then, as the user continues to pivot latch 148 clockwise, spiral contact surface 156A on draw member 156 acts on catch 132 to impart a contact force 408 (FIG. 4A) that is normal to contact surface 132B on the catch. Because contact surface 132B is sloped as shown, contact force 408 has not only a horizontal component 408H, which acts to draw lower and upper check rails 116, 120 together (as indicated by arrows 412 (FIG. 4A)), but also a vertical component 408V, which acts to cause upper sash 104 to move downward (as indicated by arrow 416) and/or cause lower sash 108 to move upward (as indicated by arrow 420). As those skilled in the art should be able to readily envision, as the user continues to pivot latch 148 clockwise the movement of upper and lower sashes 104, 108 continues until draw member 156 is at nadir 132C of contact surface 132B of catch 132. At that point, which is best shown in FIG. 1B, upper surfaces 116A, 120A of lower and upper check rails 116, 120, respectively, are flush with one another. In addition, if latch 148 is pivoted to its fully engaged position, as illustrated in FIG. 1A, gap 400 (FIG. 4A) will be at a minimum.

Figure 5A:
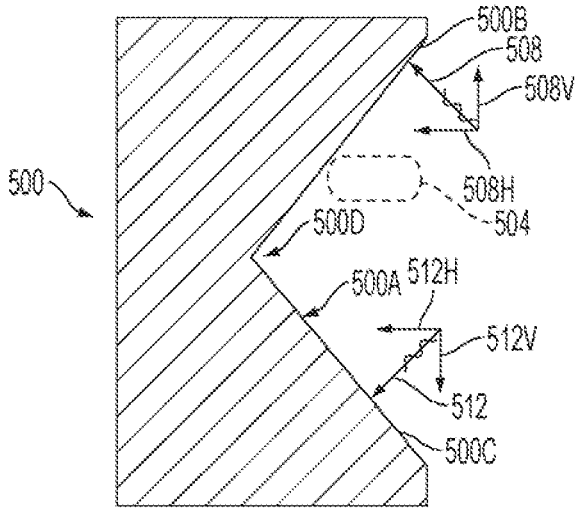
FIG. 5A is an enlarged vertical cross-sectional view of another embodiment of the catch of an alternative sash lock made in accordance with the present invention.
Figure 5B:
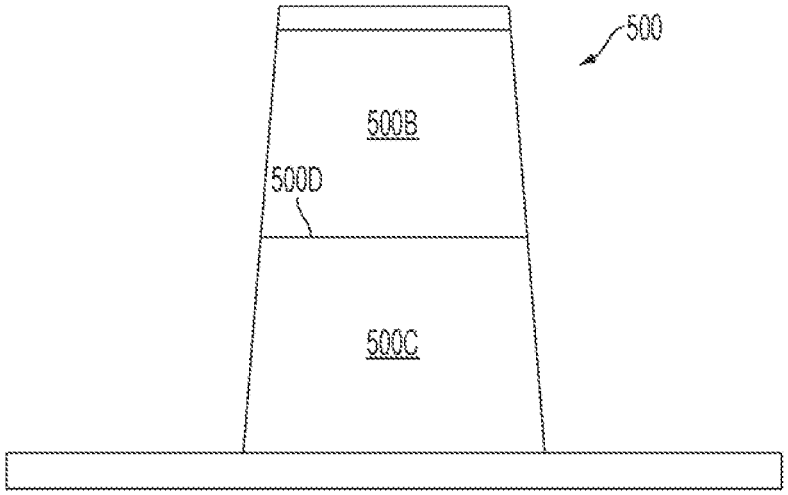
FIG. 5B is an enlarged elevational view of the catch of FIG. 5A.

FIGS. 5A-B illustrate an example of an alternative catch 500 that can be used in a sash lock, such as sash lock 112 of FIGS. 1A-B to provide the dual vertical alignment functionality just described relative to catch 132. Like catch 132, catch 500 of FIGS. 5A-B has a contact surface 500A that, when viewed in a vertical plane, is concave in a direction away from the window pane (not shown) of the upper sash (not shown) to which catch 500 is attached. However, in this embodiment, contact surface 500A is defined by two substantially straight portions, i.e., an upper portion 500B and a lower portion 500C, that converge at a vertex 500D. In this embodiment, vertex 500D is equivalent to nadir 132C of catch 132 of FIG. 1B, such that when the upper surfaces of the lower and upper check rails (not shown) are flush with one another and the sash lock is fully engaged, the draw member 504 is located substantially at vertex 500D (FIG. 5A). Also similar to catch 132 of FIG. 1A, upper portion 500B of contact surface 500A acts to bring the lower and upper check rails into vertical alignment with one another when the upper surface of the upper check rail of the lower sash is initially higher than the upper surface of the lower check rail of the upper sash. Similarly, lower portion 500C of contact surface 500A acts to bring the lower and upper check rails into vertical alignment with one another when the upper surface of the upper check rail of the lower sash is initially lower than the upper surface of the lower check rail of the upper sash. These alignment actions similarly occur as a result of the respective contact forces 508, 512 having vertical components 508V, 512V in addition to horizontal components 508H, 512H. As an example of the slope of upper and lower portions 500B, 500C, each of these portions preferably, but not necessarily, has a vertical angle, V, of about 15° or more.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A sash lock for a window installation having an upper sash and a lower sash, wherein 1) the upper sash includes a window pane and a lower check rail having a first upper side, 2) the lower sash includes an upper check rail having a second upper side, and 3) at least one of the upper and lower sashes is slidable relative to the other of the upper and lower sashes in a vertical plane parallel to the window pane, the sash lock comprising:

a latch configured to be secured to the upper check rail of the lower sash on the second upper side in a manner that said latch is pivotable horizontally, said latch including a draw member having a catch-contacting surface that is arcuate in a horizontal plane; and a catch configured to be fixedly secured to the lower check rail of the upper sash on the first upper side, said catch including a draw-member-contacting surface for slidingly receiving said catch-contacting surface of said latch, wherein, when the sash lock is installed in the window installation, said draw-member-contacting surface:

is concave in a vertical plane perpendicular to the window pane and in a direction perpendicularly away from the window pane;

has an upper portion for contacting said catch-contacting surface of said draw member so as to generate a first point-contact force having:

a horizontal component for drawing the upper and lower check rails together; and a vertical component for vertically aligning the upper and lower check rails with one another; and has a lower portion for contacting said catch-contacting surface of said draw member so as to generate a second point-contact force having:

a horizontal component for drawing the upper and lower check rails together; and a vertical component for vertically aligning the upper and lower check rails with one another.

2. A sash lock according to claim 1, wherein each of said upper and lower portions of said draw-member-contacting surface is curved in a vertical plane perpendicular to the window pane when the sash lock is installed in the window installation.

3. A sash lock according to claim 2, wherein said upper and lower portions of said draw-member-contacting surface form a continuous curve.

4. A sash lock according to claim 3, wherein said continuous curve has a radius of less than about 1 inch.

5. A sash lock according to claim 1, wherein each of said upper and lower portions of said draw-member-contacting surface is substantially straight in a vertical plane perpendicular to the window pane when the sash lock is installed in the window installation and said upper and lower portions meet at a vertex.

6. A sash lock according to claim 5, wherein each of said upper and lower portions has a vertical angle of at least about 15 degrees.

7. A sash lock according to claim 1, wherein said catch has a lower end fixed to a base that is securable to the lower check rail of the upper sash.

8. A sash lock according to claim 7, wherein said catch has an upper end and the sash lock further includes a support for horizontally supporting said upper end of said catch.

9. A sash lock according to claim 8, wherein said support comprises:

a horizontal member fixedly secured to said upper end of said catch and spaced from said base; and a pair of posts connecting opposing ends of said horizontal member to said base, said pair of posts spaced from said catch on opposing sides of said catch.

10. A window installation, comprising:

an upper sash that includes a window pane and a lower check rail having a first upper side;

a lower sash that includes an upper check rail having a second upper side, wherein:

at least one of said upper and lower sashes is slidable relative to the other of said upper and lower sashes in a vertical plane parallel to said window pane; and said upper and lower sashes have a desired vertical alignment relationship when properly locked together; and a sash lock that includes:

a latch secured to said upper check rail of said lower sash on said second upper side in a manner that said latch is pivotable horizontally, said latch including a draw member having a catch-contacting surface that is arcuate in a horizontal plane; and a catch fixedly secured to said lower check rail of said upper sash on said first upper side, said catch including a draw-member-contacting surface for slidingly receiving said catch-contacting surface of said latch, wherein said draw-member-contacting surface:

is concave in a vertical plane perpendicular to said window pane and in a direction perpendicularly away from said window pane;

has an upper portion for contacting said catch-contacting surface of said draw member so as to generate a first point-contact force having:

a horizontal component for drawing said upper and lower check rails together; and a vertical component for vertically aligning said upper and lower check rails with one another;

has a lower portion for contacting said catch-contacting surface of said draw member so as to generate a second point-contact force having:

a horizontal component for drawing said upper and lower check rails together; and a vertical component for vertically aligning said upper and lower check rails with one another; and has a nadir between said upper and lower portions, wherein, when said upper and lower sashes are properly locked together by said sash lock and are in the desired vertical alignment, said draw member is located substantially at said nadir.

11. A window installation according to claim 10, wherein each of said upper and lower portions of said draw-member-contacting surface is curved in a vertical plane perpendicular to said window pane.

12. A window installation according to claim 11, wherein said upper and lower portions of said draw-member-contacting surface form a continuous curve.

13. A window installation according to claim 12, wherein said continuous curve has a radius of less than about 1 inch.

14. A window installation according to claim 10, wherein each of said upper and lower portions of said draw-member-contacting surface is substantially straight in a vertical plane perpendicular to the window pane when the sash lock is installed in the window installation and said upper and lower portions meet at a vertex that defines said nadir.

15. A window installation according to claim 14, wherein each of said upper and lower portions has a vertical angle of at least about 15 degrees.

16. A window installation according to claim 10, wherein said catch has a lower end fixed to a base secured to said lower check rail of said upper sash.

17. A window installation according to claim 16, wherein said catch has an upper end and the sash lock further includes a support for horizontally supporting said upper end of said catch.

18. A window installation according to claim 17, wherein said support comprises:

a horizontal member fixedly secured to said upper end of said catch and spaced from said base; and a pair of posts connecting opposing ends of said horizontal member to said base, said pair of posts spaced from said catch on opposing sides of said catch.

* * * * *